United States Patent [19]

Harrington

[11] 3,967,105

[45] June 29, 1976

[54] TRANSISTOR POWER AND ROOT COMPUTING SYSTEM

[75] Inventor: Daniel Clayton Harrington, Fridley, Minn.

[73] Assignee: Control Data Corporation, Minneapolis, Minn.

[22] Filed: May 19, 1975

[21] Appl. No.: 578,567

[52] U.S. Cl. ..... 235/197; 235/193.5; 235/194; 307/229; 328/145

[51] Int. Cl.[2] ..... G06G 7/16; G06G 7/20

[58] Field of Search ..... 235/197, 193.5, 193, 235/194; 328/144, 145; 307/229, 230

[56] References Cited

UNITED STATES PATENTS

| | | | |
|---|---|---|---|
| 3,328,569 | 6/1967 | Brewster | 328/144 X |
| 3,329,836 | 7/1967 | Pearlman et al. | 328/145 X |
| 3,393,306 | 7/1968 | Kundu | 235/193.5 X |
| 3,492,471 | 1/1970 | Crowell | 235/194 |
| 3,790,819 | 2/1974 | Chamran | 307/229 |

*Primary Examiner*—Joseph F. Ruggiero
*Attorney, Agent, or Firm*—William J. McGinnis, Jr.

[57] ABSTRACT

A transistorized non-linear device is provided for converting input voltage signals to logarithmic current output signals and input current signals to exponential output voltage signals. This is performed using operational amplifiers having as the reference current for the computational element the collector current of a transistor which is operated with a near zero collector-base voltage. Square, square root, product and geometric mean functions are shown in circuits according to the invention.

13 Claims, 9 Drawing Figures

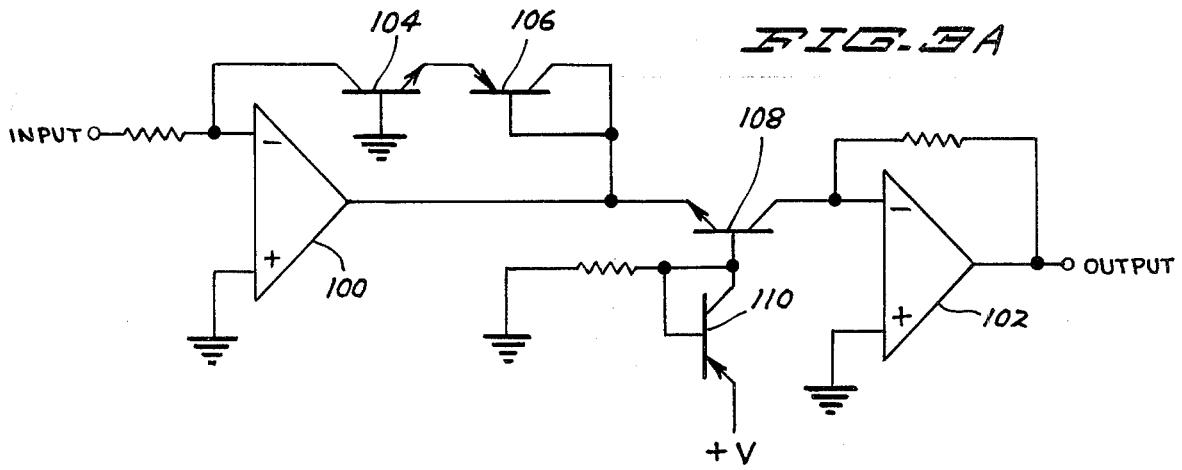
FIG. 3A
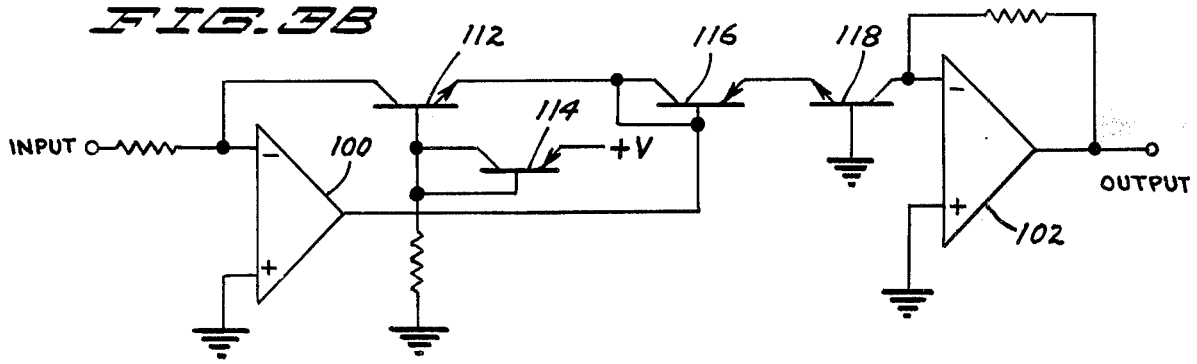
FIG. 3B
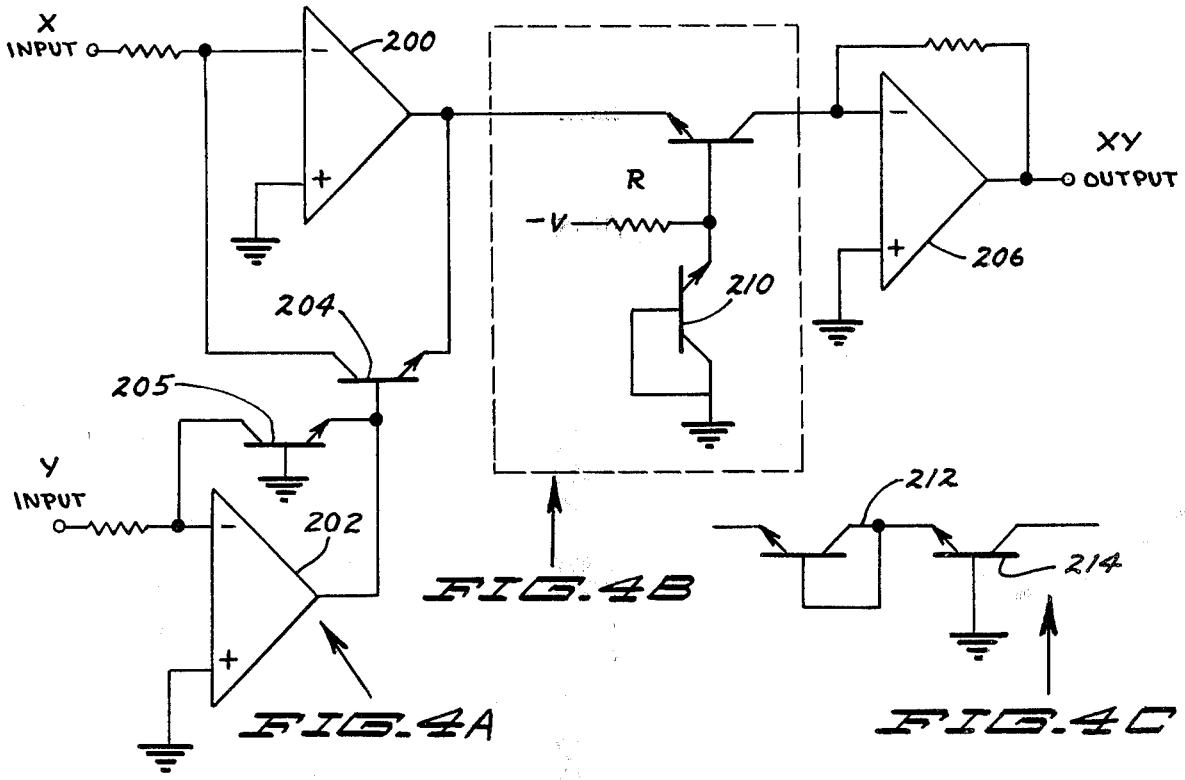
FIG. 4B
FIG. 4A
FIG. 4C

TRANSISTOR POWER AND ROOT COMPUTING SYSTEM

BACKGROUND OF THE INVENTION

This invention relates to non-linear applications of transistors in uses for computing powers of numbers represented by analog signals and similarly computing roots of analog represented numbers. More particularly this invention shows the use of transistors in non-linear circuits operating in connection with operational amplifiers to compute functions in the form of output analog signals from input analog signals.

Various non-linear response characteristics are useful in machine or computer control systems, usually for the purpose of compensating for existing non-linearities such as an exponential function to linearize a logarithmic characteristic and a square root function to compensate for a square response characteristic. The exponential variation of a semi-conductor diode current with junction voltage has been used. However, surface leakage in semi-conductor diodes and recombination currents detract from the purity of the observed characteristic since there are underlying complexities to the response. The collector current of a diffused base, bipolar transistor is a more nearly exact exponential function of the base-emitter voltage. This is because the complexities, previously mentioned, associated with the diode current and junction voltage relationship, only contribute to the base-emitter current function.

U.S. Pat. No. 3,152,250 issued Oct. 6, 1964 to G.E. Platzer and U.S. Pat. No. 3,423,578 issued Jan. 21, 1969 to G.E. Platzer, et al. show the use of the non-linear response characteristics of transistors for the purpose of controlling industrial equipment. However, these devices do not possess the inherent advantages of the present invention, as will be described further.

As further background to this invention, FIG. 1A shows a common base configuration transistor 10 in a form combined with an operational amplifier 12, shown by the functional triangular symbol commonly employed. This is a standard, known type of circuit for using an operational amplifier to produce a non-linear function based on the characteristics of the transistor. In the situation where a logarithmic function is desired, an input voltage across input resistor 14 produces a linear current response at the output 16. With high gain, the amplifier input voltage must be nearly zero so that an output base-emitter voltage is produced to duplicate the same current in the collector of transistor 10. This voltage, as previously mentioned, is an accurate logarithmic function of the current and thus of the input voltage.

In FIG. 1B, an example of an exponential function is shown in which the input voltage across the base-emitter diode of transistor 18 produces an exponential current which is duplicated in the feedback resistor 20 giving an exponential output voltage at 22. Because of the temperature dependence of base-emitter voltage, the circuits shown in FIGS. 1A and 1B, if used seperately, must be temperature controlled to be useful. The greatest utility occurs when the circuits shown in FIGS. 1A and 1B are combined using matched transistors sharing a common heat sink to allow temperature compensation of the combined circuit. Since the transistor in the one case is NPN and the other is PNP, close thermal coupling as in a common integrated circuit is difficult to achieve.

Referring now to FIG. 2A, a conventional prior art square root circuit is shown. This is because the ratio of resistor 30 to resistor 32 is 1:2 so that a gain of one-half divides the logarithmic voltage generated at transistor 34 to produce an output current and thus a voltage at resistor 32 which is a square root function of the input. Of course, any reasonable power or root function can be produced by varying the resistor ratio, including fractional powers or roots using this circuit. Also additional input logarithmic functions can be added or subtracted with various weighting values to make complex functions possible. The resistance values associated with the summing amplifier 36 must be accurate for precise functional operation of the circuit, but the input and output resistors only affect linear gain.

Referring now to FIG. 2B a prior art square root circuit is shown. This circuit is an example of a circuit in which simple functions such as square root, reciprocal and the product of two voltages are produced without using the extra summing amplifier as shown in FIG. 2A. Transistor 40 generates a reference collector current which is applied to the two base-emitter junctions in a series combination. This combination of base-emitter junctions in series is shown by transistors 42 and 44 as well as transistors 46 and 48, respectively. A fixed current through the lower junction, that is transistors 44 and 48, respectively, of each series fixes the lower junction voltage while the reference current is bypassed by the collector of the upper transistor, that is transistors 42 and 46, respectively.

Any change in reference current produces a change in voltage across the upper junction. This change is divided by the second pair of series connected base-emitter junctions producing a current equivalent to half the logarithmic voltage, in other words a square root current function. The second reference current is converted to a square root voltage function by the second operational amplifier 50. This square root arrangement which is shown by D.T. Smith, of the Clarendon Lab, Oxford, England, in an article entitled "A Square Root Circuit to Linearize Feedback In Temperature Controllers," published in the Journal of Scientific Instruments, 1972, Volume 5, Pages 528–529 shows that equal numbers of PNP and NPN types of transistors can be matched in two separate transistor strings. However, this circuit, unlike the type shown in FIG. 2A having three operational amplifiers, uses base-emitter current as a reference rather than the more precise base-emitter voltage and collector current relationship. In the input signal conversion process, the current which balances the input current includes leakage-recombination current components which cause the output reference current to be smaller than required for the precise mathematical relationship desired. Some of this too small output current is again converted to leakage-recombination components in the output string of amplifiers thus producing a voltage that is also too small. This causes a degradation of results. A similar version of the circuit shown in FIG. 2B subtracts the input logarithm from a reference constant to produce a reciprocal function. To produce a squared result, it is necessary to connect two circuits in series to add logarithms making a product function with common inputs.

While the foregoing has represented a lengthy review of the prior art for this invention, it has been necessary to discuss this in sufficient detail to show the advantages of the present invention. As will be made clear in the following discussion of the present invention, great advantages are obtained by the new type of circuit presented herein. To some extent the advantages of the present invention over the prior art result from subtle complexities of the circuit.

SUMMARY OF THE INVENTION

The present invention shows the combination of transistors operating in a non-linear mode with operational amplifiers to produce results which are analog signals bearing an exponential or root relationship to the analog input signals. The circuit, in various forms, can be used to convert input voltage to logarithmic output current and input current to exponential output voltage using high gain operational amplifiers. The reference current which flows in the operational amplifier summing resistor to produce the desired functions is always the collector current of a transistor having an essentially zero collector-base voltage. Diode reference currents or transistor emitter reference currents are not sufficiently logarithmic for this use. The temperature dependence of the transistor non-linear functions in the logarithmic mode is compensated by using a transistor chain containing the same number of transistors in the input to the operational amplifier which produces the exponential function from the logarithmic input. Further, the various fixed voltages which are required in various portions of the circuits shown which are necessary to derive the various power or root function are transistor base voltages. The transistor base voltages are obtainable with negligible junction current differences along the strings of transistors, thus avoiding degradation of the result output signal.

In the figures:

FIG. 1A relates to the prior art and has been described in the aforegoing section relating to the background of the invention.

FIG. 1B relates to the prior art and has been described in the aforegoing section of this application dealing with the background of the invention.

FIG. 2A relates to the prior art and has been described in the aforegoing section of this application dealing with the background of the invention.

FIG. 2B relates to the prior art and has been described in the aforegoing section of this application dealing with the background of the invention.

FIG. 3A is a circuit according to the present invention in which the output signal has a square functional relationship to the input signal.

FIG. 3B is a circuit according to the present invention in which the output signal has a square root functional relationship to the input signal.

FIG. 4A is an operational amplifier circuit according to the present invention for producing either a product or geometric mean function depending upon the element inserted in the dotted line box.

FIG. 4B shows an element to be inserted in a dotted line box of FIG. 4A to produce a product function in the circuit shown in FIG. 4A.

FIG. 4C is an element according to the present invention to be inserted in the dotted line box of FIG. 4A to produce a geometric mean function, that is the square root of the Products of the input signals, at the output of the circuit in FIG. 4A.

DESCRIPTION OF THE PREFERRED EMBODIMENTS

Figure 1A:
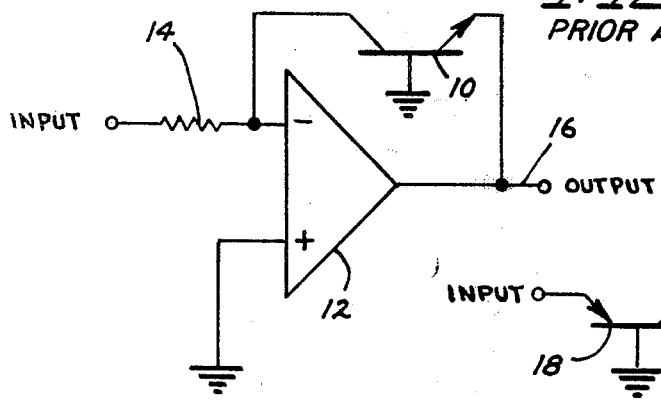
FIG. 1A PRIOR ART

Referring now to FIGS. 3A and 3B, a circuit according to the present invention is shown that can be used, as shown in FIG. 3A, for squaring or, as shown in FIG. 3B, for finding the square root of an analog input signal by merely switchably interchanging the two logarithmic elements connected at the operational amplifier input. This can be seen by comparing the two circuits of FIG. 3A and 3B as fully drawn out. In addition, the reference currents are all drawn from transistor collectors insuring the most accurate logarithmic functional relationship.

In both FIGS. 3A and 3B the input operational amplifier is designated as reference 100 and the output operational amplifier is designated as 102. Referring now to FIG. 3A an input string of transistors consisting of transistors 104 and 106 provide the logarithmic function which is operated upon by the exponential function generated by an output string of transistors consisting of transistors 108 and 110. Transistor 108 is active while transistor 110 acts like a diode to fix the base voltage of transistor 108. Referring now to FIG. 3B the logarithmic function is first provided by input string 112 and 114, of which transistor 112 is active and transistor 114 provides a fixed voltage at the base of transistor 112. Transistors 116 and 118 are the output string and provide the exponential function. Both transistors 116 and 118 are active. It is to be observed that the number of transistors in these two strings for the exponential and for the logarithmic functions is two in each case so that a compensating temperature balance is obtained. However, the function produced is dependent on the number of active transistors in the strings.

Other powers and roots or combinations of various functions can be obtained by adding active element transistor junctions to both transistor input and output strings. In this context an active element is referred to as a transistor string for providing either an exponential relationship or a logarithmic relationship. Any power given by the ratio of two integers seems possible, limited only by the sum of transistor junction voltage drops and the logarithmic signal outputs approaching power supply voltage. Unlike the conventional circuit, both transistor strings can be arranged to contain the same number of NPN and PNP transistors to obtain temperature stability. Transistors of like polarity can be matched to one another and combined on a common heat sink. Ideally, all transistors should be in the same environmental package.

Figure 2A:
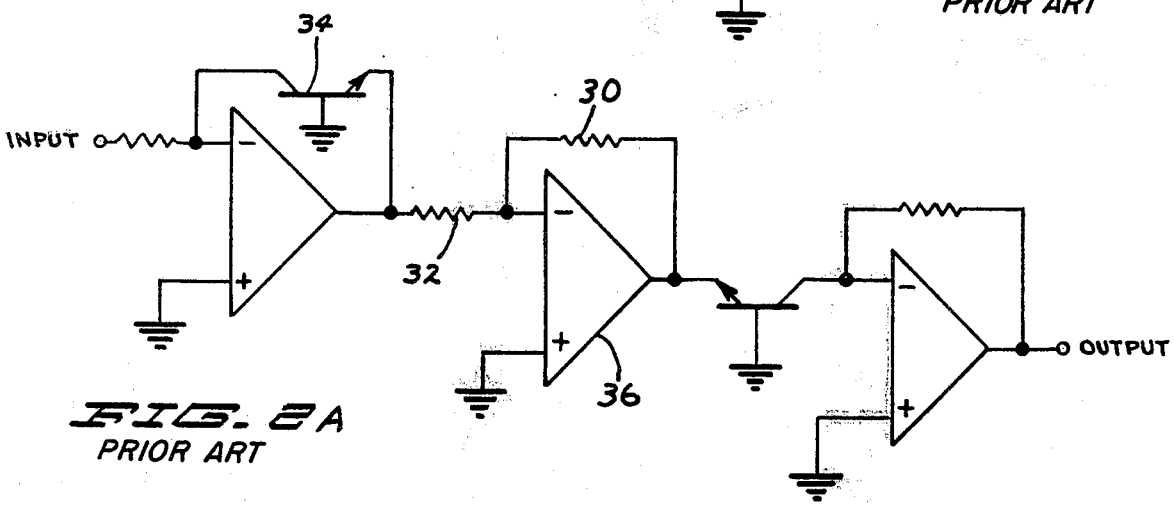
FIG. 2A PRIOR ART
Figure 2B:
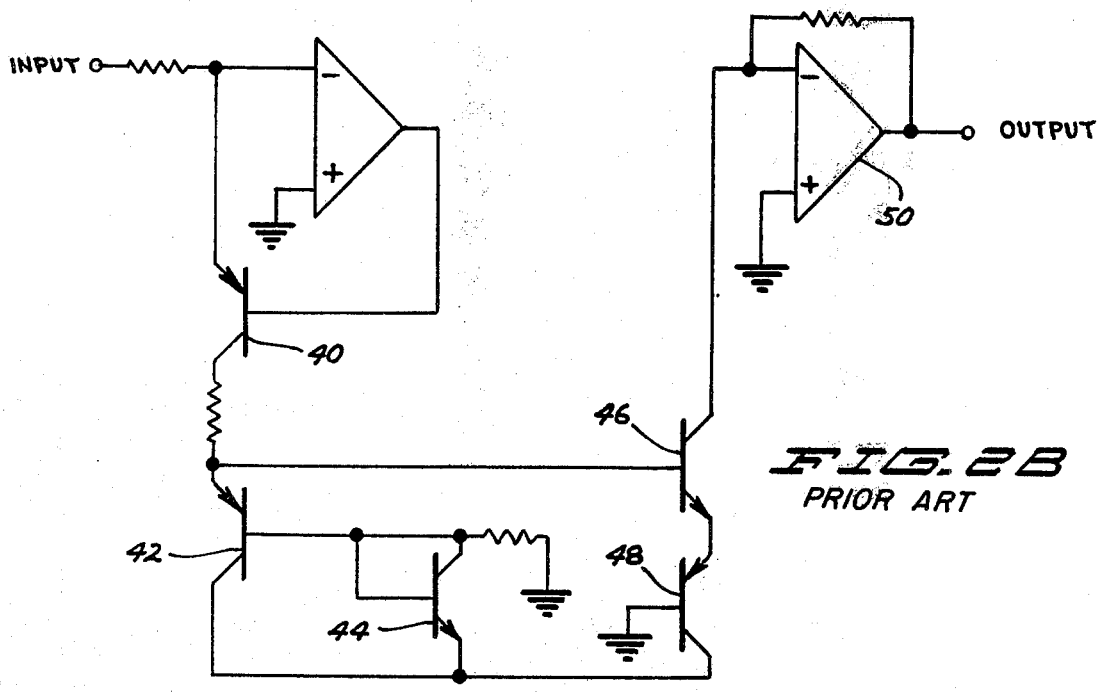
FIG. 2B PRIOR ART

While prior art circuits depend on the ratio of resistances for their characteristics, in FIG. 2A the ratio of resistances 30 and 32 for example, the present invention provides circuits for which the functional characteristics are determined by the ratio of the number of active transistors in the input string to the number of active transistors in the output string. As previously stated in connection with FIG. 3A, the input logarithmic string of transistors contains two active elements, transistors 104 and 106 and a single active element, transistor 108 in the output string, hence a square function is produced. Similarly in FIG. 3B, the input string contains a single active logarithmic element and the output string two active exponential elements, hence a square root function is produced.

Since the number of transistors will be kept the same in the output string as in the input string, the total number of transistors does not determine the function produced. Rather, the number of transistors in the input and output strings which serve as active elements will control the functional relationship between input and output. Another way of determining transistor active elements is by observing the number of transistor function voltage drops that vary with signal level between input and output strings. Inactive junctions are added to the shorter string of transistors for temperature stability.

In general, the functional relationship of these circuits leads to the formula:

$$Z = X^{a/b}$$

where $Z$ = output voltage $X$ = input voltage $a$ = number of active elements in the input transistor string $b$ = number of active elements in the output transistor string.

An experimental prototype of the squaring circuit of FIG. 3B has been made using Model 741 operational amplifiers, 2N2218 NPN transistors and 2N2906 PNP transistors.

It was found with the above identified components that no bias or offset voltage or current trimming was required in order to obtain less than 1% accuracy while the square root circuit of FIG. 3B, using the same components, needed only slight input voltage offset compensation. Tests of the logarithmic characteristics of the two transistor types indicated that the 2N2906 PNP transistors were excellent but that a better choice then the NPN 2N2218 transistor might be desirable.

Figure 1B:
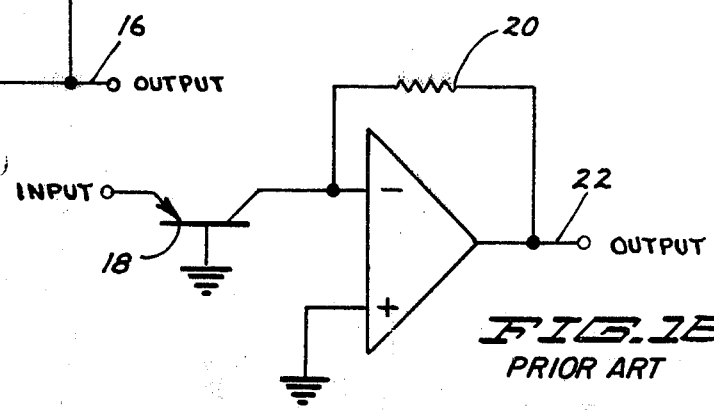
FIG. 1B PRIOR ART

The same excellent logarithmic relation between base-emitter voltage and collector current also allows a predictable current voltage versus temperature characteristic if one variable is held constant. In particular, at a fixed collector current, the base-emitter voltage is a linear function of temperature over a wide range of values down to approximately absolute zero. This makes it possible to measure absolute temperature without calibration using two known values of current and measuring voltage differences. The logarithmic amplifier circuit of FIG. 1 provides the required near zero collector base voltage for wide operating range.

With more than one input signal and using the sums or differences of junction voltages, the products of numbers may be simulated. A simple product of two variables is produced by the circuit shown in FIG. 4A using the element of FIG. 4B inserted in the dotted line box. The base-emitter voltage of the output exponential element is equal to the sum of the two inputs. Because of the limited range of the junction voltages, an extra fixed voltage is added to the output string of transistors. By reversing the combination, using the element shown in FIG. 4C in the dotted line box of FIG. 4A, the input voltage changes can be divided between transistor junctions giving a geometric mean, $$Z = (XY)^{1/2}$$

Subtraction of one logarithmic voltage from the other allows implementation of reciprocal and division functions.

The circuit of FIG. 4A can be readily understood by realizing that operational amplifiers 200 and 202 perform operations on the X and Y inputs respectively, as labeled in the figure. Transistors 204 and 205 provide initial logarithmic functions for the input signals. Output operational amplifier 206 amplifies and produces the output signal as determined from the transistor combination 208 and 210 as shown in FIG. 4B or from transistor 212 and 214 as shown in FIG. 4C. Transistors 204 and 205 are both active. In FIG. 4B transistor 208 is active and in FIG. 4C both transistor 212 and 214 are active.

It is to be understood that diffused base, bipolar transistors are considered to be suitable computational elements in the foregoing examples. It is also to be understood that the various resistors associated with the operational amplifiers may be varied to adjust the output signal level without varying the functional characteristics of the circuits according to my invention.

What is claimed is:

1. A non-linear transistor computing element comprising:

an operational amplifier having an output and positive and negative inputs, a first transistor having its collector connected to the negative input of said amplifier, and a second transistor having its base connected to the output of said amplifier, said first and second transistors being operably connected so that the output of said operational amplifier is determined by the feedback loop comprising said first and second transistors and having a non-linear relationship to the input determined by the collector current of at least one of said transistors operating with a near zero collector base voltage.

2. A circuit for producing an output having a power functional relationship to the input comprising the structure of claim 1 and further comprising:

a second operational amplifier having an output and positive and negative inputs, a third transistor having its collector connected with the negative input of said second operational amplifier and its emitter connected with the output of said first operational amplifier, a fourth transistor having its collector connected to the base of said third transistor and its base connected to its collector, a first resistor connected to the negative input of said first operational amplifier and having as its input the input to said circuit, and a second resistor connected between the output of said second operational amplifier and the negative input thereof.

3. The circuit of claim 2 in which a square functional output to input relationship is produced.

4. A circuit for producing an output having an inverse power functional relationship to the input comprising the structure of claim 1 and further comprising:

a second operational amplifier having an output and positive and negative inputs, a third transistor having its collector connected with the base of said first transistor and having its base connected to its collector, a fourth transistor having its collector connected to the negative input of said second operational amplifier and its emitter connected with the emitter of said second transistor, a first resistor connected to the negative input of said first operational amplifier and having as its input the input to said circuit, and a second resistor connected between the output of said second operational amplifier and the negative input thereof.

5. The circuit of claim 2 in which a square root functional output to input relationship is produced.

6. A circuit for producing an output having a product functional relationship to first and second inputs comprising the structure of claim 1 and further comprising:

a second operational amplifier having an output and positive and negative inputs, the output of said second operational amplifier being connected to the emitter of said second transistor and the negative input of said second operational amplifier being connected to the collector of said second transistor, a third transistor having its emitter connected with the output of said second operational amplifier, a fourth transistor having its emitter connected with the base of said third transistor and having its base and collector connected, a third operational amplifier having an output and positive and negative inputs, said negative input being connected to the collector of said third transistor, a first resistor connected to the negative input of said first operational amplifier and having as its input one of said inputs to said circuit, a second resistor connected to the negative input of said second operational amplifier and having as its input the second input to said circuit, and a third resistor connected between the output of said third operational amplifier and the negative input thereof.

7. A circuit for producing an output having a geometric means functional relationship to first and second inputs comprising the structure of claim 1 and further comprising:

a second operational amplifier having an output and positive and negative inputs, the output of said second operational amplifier being connected to the emitter of second transistor and the negative input of said second operational amplifier being connected to the collector of said second transistor, a third transistor having its emitter connected to the output of said second operational amplifier and its base connected to its collector, a fourth transistor having its emitter connected to the collector of said third transistor, a third operational amplifier having an output and positive and negative inputs, the negative input thereof being connected to the connector of said fourth transistor, a first resistor connected to the negative input of said first operational amplifier and having as its input one of said inputs to said circuit, a second resistor connected to the negative input of said second operational amplifier and having as its input the second input to said circuit, and a third resistor connected between the output of said third operational amplifier and the negative input thereof.

8. The circuit of claim 1 wherein said transistors are diffused base bipolar transistors.

9. A computational circuit having a non-linear input voltage to output voltage functional relationship comprising a first operational amplifier having as its input the input voltage to said circuit, an input transistor string associated with said first operational amplifier, said string having at least one active element transistor which has a near zero collector-base voltage and the collector current serves as the computational reference, a second operational amplifier having as its output the output voltage for said circuit, and an output transistor string connecting the output of said first operational amplifier to the input of said second operational amplifier, said string having at least one active element transistor which has a near zero collector-base voltage and the collector current serves as the computational reference, said circuit having an input voltage to output voltage functional relationship defined by an equation of the type:

$$Z = X^{a/b}$$

where $Z$ = output voltage $X$ = input voltage $a$ = number of active elements in the input transistor string $b$ = number of active elements in the output transistor string

10. The circuit of claim 9 in which the number of transistors in the output string is the same as the number of transistors in the input string so that temperature compensation is obtained.

11. The circuit of claim 9 and further comprising a third operational amplifier having as its input a second input to said circuit, and a second input transistor string associated with said third operational amplifier, said string having at least one active element transistor which has a near zero collector-base voltage and the collector current serves as the computational reference, the output of said third operational amplifier being summed with the output of said first operational amplifier.

12. The circuit of claim 11 in which there is one active element in the output transistor string and the product of the inputs is the output of said circuit.

13. The circuit of claim 11 in which there are two active elements in the output transistor string and the geometric mean of the inputs is the output of said circuit.

* * * * *